United States Patent [19]

Simpson

[11] Patent Number: 4,570,717

[45] Date of Patent: Feb. 18, 1986

[54] ANTI-TWIST CONTROL SYSTEM FOR DEVIATED CONDUCTOR DRIVING SYSTEMS

[76] Inventor: James K. Simpson, 4334 Earhart Blvd., New Orleans, La. 70125

[21] Appl. No.: 648,816

[22] Filed: Sep. 10, 1984

Related U.S. Application Data

[62] Division of Ser. No. 499,976, Jun. 7, 1983, Pat. No. 4,497,372.

[51] Int. Cl.[4] ..... E21B 7/20

[52] U.S. Cl. ..... 166/362; 175/171; 175/61; 166/384

[58] Field of Search ..... 166/362, 381, 384, 385; 175/57, 61, 97, 171, 230, 195

[56] References Cited

U.S. PATENT DOCUMENTS 443,072 12/1890 Chapman ..... 175/195

*Primary Examiner*—Stephen J. Novosad
*Assistant Examiner*—Bruce M. Kisliuk
*Attorney, Agent, or Firm*—C. Emmett Pugh

[57] ABSTRACT

A system for controlling the deviation of the path of oil or gas well conductor casing at a desired angle, curvature and orientation in the sea bottom stratum through which it is driven from an offshore platform involving the use of conductor guide(s) equipped with longitudinally disposed anti-twist bar(s) fixedly mounted thereon to prevent or arrest any twisting motion along the longitudinal axis of the casing sections which have like, anti-twist bar as the conductor sections are being lowered or driven down from the platform. Motion is arrested by means of the bars on the conductor guide(s) contacting the similar bars fixedly attached to the casing sections being driven through the conductor guides on the platform support structure. By arresting any twisting motion at this relatively elevated point, any undesired twist is minimized in the driven casing sections minimizing any undesired horizontal deviation in the enplacement of the conductor casing which would have otherwise been caused by the twisting. Additionally or alternatively, there can be included a system using a cable or chain and winch drive to either counter-act the twist prior to the arresting of that twist or to move the twist in the opposite direction prior to the arresting of the twist or to independently position the conductor casing in a desired radial direction, so as to further control the horizontal angle at which the deviation occurs.

3 Claims, 6 Drawing Figures

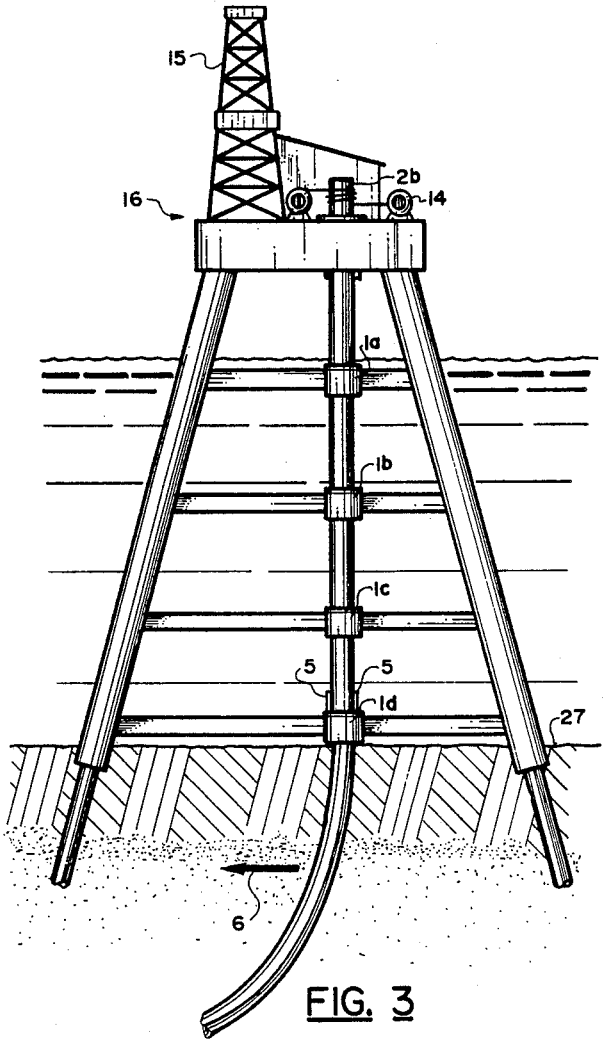
FIG. 3
FIG. 2
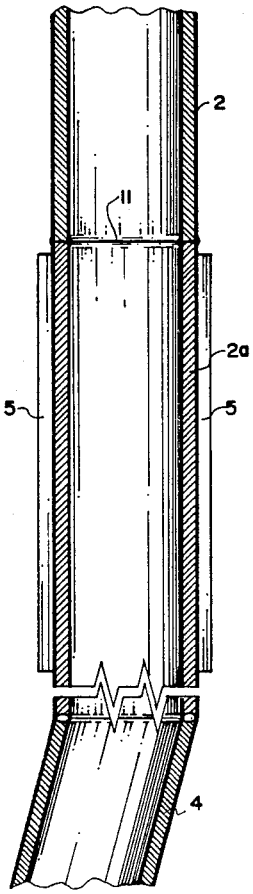

ANTI-TWIST CONTROL SYSTEM FOR DEVIATED CONDUCTOR DRIVING SYSTEMS

This application is a division, of application Ser. No. 06/499,976, filed 6/7/83 now U.S. Pat. No. 4,497,372.

BACKGROUND OF INVENTION

1. Field of Invention

The present invention relates to the directional placement of conductor pipe through some stratum or medium from an offshore platform. More particularly, the present invention relates to the directional placement of conductor strings or pipes at a desired curve and orientation from the vertical using deviated sections to facilitate the driving of the pipe or conductor string at desired and different orientations by preventing or by regulating the twist of the casing as it is hammered into the desired stratum during placement.

2. Prior Art

There are several possible uses for driving pipes at angles which vary in a deviated, off-the-vertical direction as they are driven through a stratum. This application is addressed specifically to the deviated placement of conductor casing for purposes of directional well drilling and/or dispersement of conductors on a multi-well platform to prevent conflict between conductor casings.

The need for directional drilling for oil and gas exploration and development is well known and several techniques exist for this purpose, as shown for example in U.S. Pat. No. Re. 29,929, reissued Mar. 13, 1979, and its predecessor U.S. Pat. No. 4,276,942, issued June 7, 1977, and the patents discussed and cited therein.

The idea of attempting to prevent a twist in a conductor string while it was driven down to prevent changes in direction from a desired path as the conductor string was implaced was partially considered in U.S. Pat. Nos. 4,276,943 and Re. 29,929, patents owned by the assignee hereof. Further, the use of outer, longitudinally directed "stabilizer bars" on the conductor itself at its entry end to react with the surrounding soil was recognized as being adapted to this use in those same patents.

This technique did act to prevent some twisting of the pipe but previously was only available at the point where the guiding "dog leg" section located at the front of the casing was in engagement with the soil. This technique has not been found to be one hundred percent effective, particularly when certain strata are encountered in the casing driving process, where some twisting of the casing was not adequately prevented.

The present invention is aimed at improving on the previous techniques and in minimizing this twist or controlling the twist for the purpose of controlling and further directing the horizontal deviation produced in the driving of deviated conductor casing.

3. General, Summary Discussion of the Invention

The present invention is applicable to the placement of deviated conductors from an offshore platform.

The invention utilizes in one embodiment a modified conductor guide or guides and conductor casing which use sets of longitudinally directed, mating, interdigitating, anti-twist bars modified to control the placement of the angular deviation of the casing as it is hammered into place. The conductor guide(s) are equipped along their internal diameter with jutting nodes or bars. Likewise, the outside of some of the conductor casing sections are similarly equipped with jutting, longitudinally directed bars.

The outside diameter of the conductor casing is sufficiently small so that the conductor casing can fit through and be guided by the conductor guide(s) despite the presence of the anti-twist bars on the inside of the conductor guides and on the outside circumference of the casing sections. However, the diameters of the conductor guide(s) and the conductor casing are sufficiently close so that the bars on the conductor guide(s) will contact the sides of the anti-twist bars on the casing sections if the casing attempts to twist away from its set direction as it is driven into the stratum. The opposing, anti-twist bars by way of this contact at least substantially prevent any undesired twisting of the conductor casing along the casing's longitudinal axis.

Although the anti-twist bars or "stops" which arrest the twist of the casing are referred to as "bars" throughout this specification, it should be recognized that the shape and form of the "stops" as well as the elemental makeup of the "stops" may be varied as is structually and functionally desirable, for example to make them in a more resilient manufacture or to cause the pipe to move more downwardly or upwardly by the relative shape of the bars, without departing from the basic concept of the invention disclosed herein.

For reasons which will become apparent, it may be desired that the speed with which the casing twists before being arrested is either increased or decreased prior to being arrested. For this purpose, a cable or chain (or other band, wheel or roller) and winch apparatus is provided in a second embodiment, so that the motion of the casing along its longitudinal axis is either increased or decreased as it is driven downwardly by the driving hammer. This cable or chain (of other band, wheel or roller) is made to contact the pipe by wrapping the cable or chain (or other band, wheel or roller) around the outer diameter of the casing or by otherwise contacting the casing. The cable or chain (or other band, wheel or roller) may be made to twist with or against the twisting of the pipe, so as to increase or slow down the pipe's movement along its longitudinal axis (the twist of the pipe) by winding the chain, etc. in one direction or the other as it is wrapped around or pressed against the pipe. Primarily, this "wrapping" technique could be used as an independent control system regardless of any interdigitating "bar" anti-twist system on the guide(s) and conductor casing sections.

The utility of this invention is that, when the undesired "twist" movement of the pipe is minimized or arrested, the improper placement of the deviation is avoided, as the conductor sections are driven into the stratum where the casing is to be placed. The present invention thus is useful for minimizing improper or undesired horizontal deviations or giving greater control to the desired deviation and to the amount and direction of deviation.

Because the twist may be such as to crack or break structures, such as the bars used in this invention, due to the great forces which can be developed, the invention also provides for the design of cable or chain and winch arrangements to minimize the twist prior to the bars being contacted.

The present invention may be used in concert with one of the other deviation systems such as slanted or jutting dog legs and other attaching direction slanting devices or systems known in the art.

BRIEF DESCRIPTION OF THE DRAWINGS

For a further understanding of the nature and objects of the present invention, reference should be had to the following detailed description, taken in conjunction with the accompanying drawings in which like parts are given like reference numerals and wherein:

FIG. 2 is a side, cross-sectional view of the preferred embodiment of the invention mounted on the conductor casing up the line from the "dog leg" or directional deviation attachment which is on the entry end of the foremost casing section.

FIG. 3 is a generalized, schematic, side view of a marine structure equipped with the preferred, exemplary embodiment of the present invention.

DETAILED DESCRIPTION OF THE PREFERRED EXEMPLARY EMBODIMENTS

Figure 1:
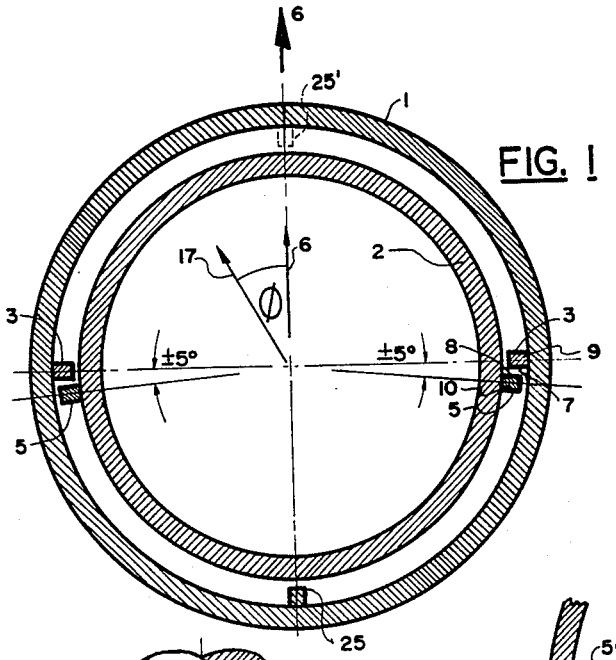
FIG. 1 is a plan, cross-sectional view of the preferred embodiment of the present invention showing the conductor casing and conductor guide utilizing the bar anti-twist system of the present invention.

Referring to FIG. 1, the first preferred, exemplary embodiment of the anti-twist system present invention comprises a hollow, outer guide 1 which has one or more stops or longitudinally directed, inwardly and radially extending, axially disposed bar(s) 3 mounted by means of welds 9 to the inner or interior wall of the conductor guide 1. In the embodiment illustrated, two, diametrically opposed stops 3 are shown positioned opposite laterally from each other spaced one hundred and eighty degrees apart. It should be clear, however, that the number and placement of such stops 3 can be varied according to the desired design and functional needs of the platform structure and the deviated conductor and the substratum into which it is to be placed.

Fitting through the inside of conductor guide 1 is the conductor casing 2, which is to be driven into the strata or sea floor. Conductor pipe 2 is equipped with one or more, outwardly and radially extending stops 5 along its outer diameter. Here, two, diametrically opposed stops 5 are used, positioned opposite laterally from each other separated by approximately one hundred and eighty degrees and corresponding to the number and placement of stops 3 on the conductor guide 1 described above. In the embodiment of FIG. 1 the longitudinal bars 5 are each off-set by an exemplary ±five degrees from the straight one hundred and eighty degree line of the bars 3. It will become obvious that, as the number of stops 3 vary, so should the number of stops 5, in the preferred embodiment. Stops 3 are attached to the conductor casing 2 by means of welds 10 to the outer surface of the conductor casing 2.

The outer diameter of casing 2 and the inner diameter of the conductor guide 1 are such that the stops 3, 5 will contact the sides of each other, as the casing 2 moves about its longitudinal axis or "twists" from its originally set direction within the conductor guide 1. Thus, for example, should external forces arise which cause the conductor 2 to twist in a counter-clockwise direction (as viewed from the perspective of FIG. 1, the opposed, mating surfaces 7, 8 of the opposed "stop" bars 3, 5 will come into contract, stopping the twist. In this way, the stops 3, function as a lock restricting the twisting movement of the casing 2 by contacting the stops 5. Casing 2 thus acts as a key in the conductor guide 1, which functions as a lock.

Prior to hammering the conductor casing 2 for the purpose of driving in into the stratum where it is to be embedded, stops 3 and the interacting counter stops 5 may be aligned so that they made contact preventing the conductor casing pipe 2 from rotating or twisting along its longitudinal axis.

As shown in FIG. 1, the stops 3, 5 preferably are positioned so as to be at least approximately ninety degrees offset to either side of the target direction 6 along the circumference of the casing section 2 and the conductor guide 1; so that the torque may be directed in the target direction, as well as generally downwardly without as much stress being applied to the stops 3, 5. It is contemplated that the stops (and their spacing) may be so positioned and the invention so used as to control the direction in which the casing moves.

Positioner or spacer bar, shown as bar 25 in FIG. 1 affixed by welding to the conductor pipe 2 can be included to help maintain the casing 2 centrally within the guide 1, to assure that the stops 3, 5 will contact one another in any twisting of the conductor. This prevents the stops 5 from "jumping by" or past the stops 3 due to the conductor having slipped away from its central location. A further, like spacer bar 25' positioned on the same or opposite side can also be included for further assurance in this regard.

Or course the greater the difference in the relative diameters of the guide 1 and the conductor 2, the greater the need for such spacer bars 25, 25'. The extra, spacer bar(s) 25, 25' are thus added for stability of the conductor casing 2 in the guide(s) 1 and are added to prevent lateral movement of the casing in the guide.

It should be noted that the stop bars 3 and 5 may be of any length and indeed can run the entire length of the conductor casing 2 or conductor guide 1 and/or any other guides on which the stops 3 are mounted. However, it is noted that the stops 5 would generally not begin on the conductor casing 2 until well up on its length, representing the distance between where the conductor is first in the guide 1 that has the like stops 3 and where the entry end of the conductor 2 would first be subjected to a twisting force from the substrata or other external force.

Figure 4:
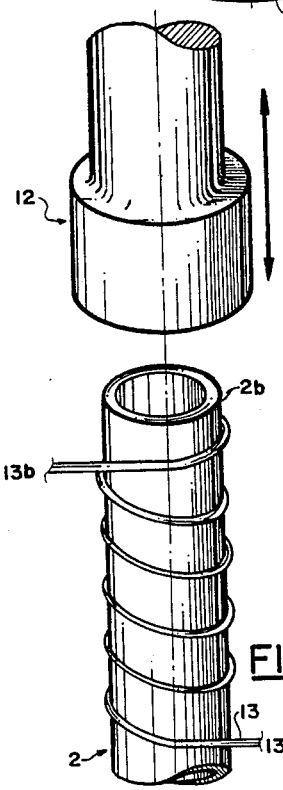
FIG. 4 is a schematic, side, view with a downward perspective of a preferred, exemplary embodiment of a cable or chain and winch twisting means for increasing or decreasing the amount of twist on the pipe casing.

Any undesired twisting of the casing 2 may be further or separately controlled by a wrapping means for reversing the twist, as shown in FIG. 4, which constitutes a second preferred embodiment of the present invention. Reciprocating hammer 12 of a type known in the art is used to drive the casing 2 into the stratum, where it is to ultimately serve as a deviated guide for one or more drill strings (not shown). A cable, chain or other band or flexible, elongated member 13 is wound about the topmost casing **2*b* or some lower length of casing, as conditions allow. One end 13*a* of the cable or chain 13 goes and is connected to the winch 14 shown in FIG. 3, while the other end 13*b* may be loosely held or attached to the conductor casing 2 by means of a pad-eye or by other means. The term "winch" should be construed broadly to include any power source to provide the necessary tension to the flexible member 13**, for example a "cat-head," tug-o-hoist, etc.

By winding the chain or chain 13 around the winch 14, the casing 2 is made to twist in the desired direction, so as to control any undesired twisting of the casing pipe cause by the action of the hammer 12 and/or the interaction of the casing 2 with the stratum. The countering twist can be produced in either direction, clockwise or counter-clockwise, by properly selecting the direction of wrap and the winch rotation direction.

It should be immediately apparent that the technique of countering any undesired twisting movement of the casing 2 with a winch 14 and cable or chain 13, and the technique of countering any twisting with bar stops 3, 5 placed along the guide(s) and conductor walls may be used independently of each other or together, depending on the equipment and conditions at hand.

FIG. 3 shows an offshore oil platform or other structure shown generally at 16, which is well known in many forms in the art. A hammer holding means or derrick 15 for holding the hammer 12, which is also well known in the art, is shown moved to the left of the uppermost casing section 2*b*. As can be readily ascertained, casing 2 is made up of many sections usually of around forty feet each in length. As can also be readily seen, a single oil rig 16 may have many conductor guides 1*a–d*.

Although all conductor guides 1 and all casing sections 2 might conceivably be equipped with bars 3, 5, respectively, it is likely that only certain guides 1 (for example 1*a*) and certain sections of the conductor casing 2 need be so equipped. The placement of the bar stops 5 on a subsequent conductor to be driven can often be based on when any undesired twisting was noted in the driving of a previous conductor. It is thus further likely that for most directional undertakings, only one to perhaps a few casing sections 2*a*, located a distance appropriately above the initial casing sections to be hammered into the substrata, need be equipped with the bar stops 5, due to the more consistent travel in the stratum after an initial, critical period.

In this initial, critical period the travel of the deviated conductor is most subject to undesired, twisting deviations and is most capable of controlled deviation by the methods of the invention and other methods known in the art. It is noted that, below approximately one hundred feet of penetration into the mud substrata, it is usually difficult if not impossible to counter any twist of the conductor from up on the surface, although of course this limit varies depending on all of the relevant conditions, particularly the characteristics of the substrata itself.

One of the benefits of a flexible system such as that of the present invention, is that, if for some reason it was necessary to counteract a twist at any given time, the opposed stop bar technique of the invention could be used at that point by welding stops 5 on that casing section 2*a* which would be passing through the conductor guide(s) 1 with the stops 3 at that time.

In practice a colored painted line is usually drawn on the first section of casing 2 parallel to its longitudinal axis and traveling its entire length on the target side 6 of FIG. 1. The target side 6 is generally considered the side on which the desired deviation is to take place, that is the side from which the "dog leg" section 4 protrudes. Similar lines are drawn on the other conductor casing sections 2 as they are connected by welds or other means to this first section 2, so that the target direction can be tracked from the rig 16 as the casing 2 is embedded. In this way the deviation direction can be constantly and reliably measured and/or checked.

The need for such a control, as can be achieved in this invention, can correct an undesired deviated direction 17 which could result from the uncontrolled or unchecked twisting of the conductor pipe 2 which would have produced for example the angle "phi" (note FIG. 1). By properly restricting the movement of the conductor pipe 2 from twisting, in accordance with either one or both of the exemplary embodiments of the present invention, such undesired horizontal deviation is minimized.

The invention in its first, exemplary, preferred embodiment is carried out by first welding stops or bars 3 to the inner surface of conductor guide 1 at the desired locations parallel to the longitudinal axis of conductor guide 1 and by welding stops or bars 5 to the outer surface of casing sections 2 at the desired locations parallel to the longitudinal axis of the casing section 2, as needed.

In the first preferred embodiment, the bars 3, 5 are positioned so that the bars 3 contact the bars 5 upon any undesired twist this contact is preferably made at an angle of ninety degrees to either side of the target direction 6 along the circumference of the casing 2, as could be indicated by for example lines painted on the casing sections 2.

Before hammering the casing 2, the casing 2 would be fed through the various conductor guides 1*a–d* in FIG. 3, including the conductor guide(s) 1*d* which has guide bars 3 welded in the desired direction.

On another point, it is noted that the cable or chain 13 may be continuous so that is continuously twists the pipe 2 opposite to the twist occasioned by the hammering and/or the interaction of the casing 2 with the stratum. The speed and degree of this counter-twisting is determined by the speed and degree necessary to offset the twist caused by striking the casing 2 with the hammer 12 and the resistance met by the conductor as it moves through the substratum. The cable or chain 13 may be made uncontinuous, rewinding by hand or otherwise from a coil, with the winch being driven in sequence with the hammer 12, so that the countering twist caused by the winch is matched to counteract the twist caused by the hammer 12 or other driving force. The twist caused by the cable or chain 13 and winch 14 may similarly be syncronized with the twist caused by the driving force which it is to counteract, so that the opposing twists occur only together.

It is also recommended that the strength of the welds 9 and 10 be designed or made so that one or the other of such welds would give before any damage is caused to the conductor guides 1 themselves.

Figure 5A:
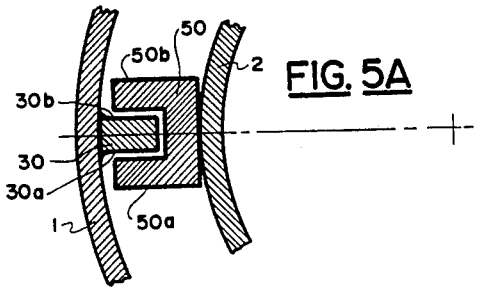
FIG. 5A is a plan, cross-sectional view of a further, second embodiment of the bar anti-twist system of the present invention, in which the anti-twist is achieved with a single integrated structure (rather than two, separate, anti-twist bars spaced approximately one hundred and eighty degrees from each other as in the embodiment of FIG. 1).
Figure 5B:
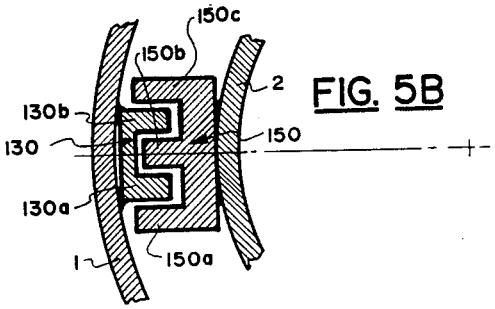
FIG. 5B is a view similar to that of FIG. 5A, but of a still further, third, interlocking embodiment.

Further, exemplary embodiments of the "stop" bar system of the present invention are shown in FIG. 5A & 5B wherein single, structures on only one side are shown for producing the effective twist prevention produced by the two, diametrically opposed, spaced, mating stop sets 3, 5 of FIG. 1.

As can be seen in FIG. 5A, one element of the stop forms a single bar 30 having two sides 30*a*, 30*b*; while the other, mating element 50 includes two spaced, bar-like walls 50*a*, 50*b*. The bar 30 extends into the stop element 50 between the walls 50*a*, 50*b*, which form a key-way as shown. Thus, the single stop set 30, 50 prevent any relative twisting of the conductor casing 2 in the conductor guide 1 to which the stop elements 30, 50 are attached—due to the contact between the opposed mating walls between the stop elements 30, 50.

In the embodiment of FIG. 5B, the interdigitating action of the single set of opposed, stop elements 30, 50 are effectively ganged in the elements 130, 150 for greater stopping or locking strength. As can be seen in the drawing, element 130 includes a channel member having bar-like extensions **130, 130*b*, while stop element 150 includes three bar-like extension 150*a*, 150*b* & 150*c*,** with the two elements and the bar-like extensions being interdigitated together.

Because many varying and different embodiments may be made within the scope of the inventive concept herein taught, and because many modifications may be made in the exemplary embodiments herein detailed in accordance with the descriptive requirements of the law, it is to be understood that the details herein are to be interpreted as illustrative and not in a limiting sense.

What is claimed is:

1. A method for countering any undesired twisting of a deviated conductor which is to be deviated in a desired direction as it is driven into a substratum from an offshore platform, comprising the following steps:

a. providing a flexible, extended member and a winch on the platform structure;

b. wrapping a portion of said flexible member about a portion of the conductor casing and connecting another portion of said flexible member to said winch; and c. When undesired twisting of the conductor casing takes place, actuating said winch to pull in said flexible member rotating the casing to an extent sufficient to counter the undesired twisting in the conductor casing.

2. The method of claim 1, wherein in step "b" there is further included the step of;

wrapping the flexible member in a spiral down along a portion of said conductor casing.

3. The method of claim 1, wherein there is further included the step of:

performing step "c" while the conductor casing is being hammered into the substratum.

* * * * *

UNITED STATES PATENT AND TRADEMARK OFFICE

CERTIFICATE OF CORRECTION

PATENT NO. : 4,570,717

DATED : February 18, 1986

INVENTOR(S) : James K. Simpson

It is certified that error appears in the above-identified patent and that said Letters Patent is hereby corrected as shown below:

On the title page, add --[73] Assignee: Gurtler, Herbert & Co., Inc., New Orleans, La. --

Signed and Sealed this

Twenty-first Day of October, 1986

[SEAL]

*Attest:*

DONALD J. QUIGG

*Attesting Officer* *Commissioner of Patents and Trademarks*